US005158420A

United States Patent [19]

Weyer

[11] Patent Number: 5,158,420

[45] Date of Patent: * Oct. 27, 1992

[54] ROTARY DIPPER STICK

[76] Inventor: Paul P. Weyer, 1462 Blake St., Enumclaw, Wash. 98022

[ * ] Notice: The portion of the term of this patent subsequent to Dec. 10, 2008 has been disclaimed.

[21] Appl. No.: 717,906

[22] Filed: Jun. 19, 1991

Related U.S. Application Data

[60] Division of Ser. No. 504,308, Apr. 6, 1990, Pat. No. 5,071,310, which is a continuation-in-part of Ser. No. 480,553, Feb. 15, 1990, Pat. No. 4,952,116, which is a division of Ser. No. 337,749, Apr. 13, 1989, Pat. No. 4,950,127.

[51] Int. Cl.[5] ..... E02F 3/75

[52] U.S. Cl. ..... 414/694; 414/705; 414/727

[58] Field of Search ..... 414/694, 697, 695.8, 414/705, 722, 727, 699; 92/33

[56] References Cited

U.S. PATENT DOCUMENTS

| | | | |
|---|---|---|---|
| 3,343,693 | 9/1967 | Becker . | |
| 3,463,336 | 8/1969 | Mork . | |
| 3,871,538 | 3/1975 | Miller et al. . | |
| 4,049,139 | 9/1977 | Stedman . | |
| 4,257,731 | 3/1981 | Beaver | 414/694 |
| 4,274,796 | 6/1981 | Phillips | 414/690 |
| 4,274,797 | 6/1981 | Coon | 414/694 |
| 4,313,367 | 2/1982 | Weyer | 92/33 |
| 4,889,466 | 12/1989 | Jindai et al. | 414/694 |
| 4,950,127 | 8/1990 | Weyer | 414/694 |
| 4,952,116 | 8/1990 | Weyer | 414/694 |
| 5,071,310 | 12/1991 | Weyer | 414/694 |

FOREIGN PATENT DOCUMENTS 2530701 1/1984 France .

OTHER PUBLICATIONS

Komatsu Brochure-PF55L All-Around Excavator-4-Page Brochure.

*Primary Examiner*—Frank E. Werner
*Assistant Examiner*—James T. Eller
*Attorney, Agent, or Firm*—Seed & Berry

[57] ABSTRACT

A vehicle having a fluid-powered rotary dipper stick assembly including a boom attachment head and a bucket attachment head with a body extending therebetween. An axle extends from the boom attachment head into the body and is in sliding engagement with an inward wall of the body to provide lateral support thereto. The axle extends to a midportion of the body. The body is rotatable relative to the axle, and is rigidly connected to the bucket attachment head for rotation together as a unit. A linear-to-rotary transmission mechanism including a piston is disposed within the body and is operable to produce rotational movement of the body relative to the non-rotating axle. The piston is operated by the application of pressurized fluid to produce linear movement of the piston which is translated into rotational movement of the body, and provides rotation of a bucket or other work implement attached thereto about the body longitudinal axis independent of the boom attachment head. The assembly uses a single thrust bearing positioned between the body and the boom attachment head to carry thrust loads in both directions. In one embodiment fluid passageways in the non-rotating axle and a rotary fluid joint conduct hydraulic fluid between the non-rotating and rotating components. In another embodiment the passageways are formed in a non-rotating bearing block of the thrust bearing.

17 Claims, 6 Drawing Sheets

FIG. 7
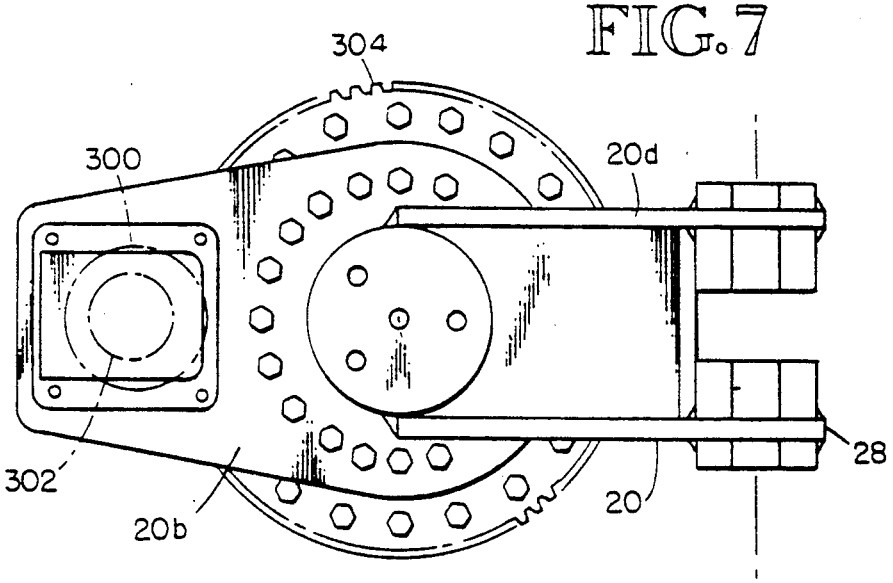
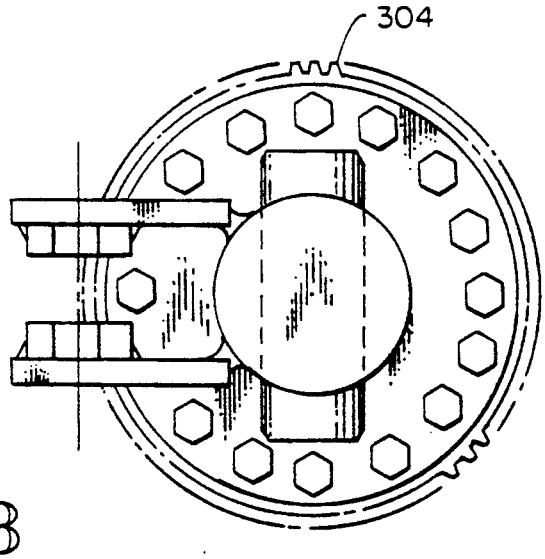
FIG. 8

ROTARY DIPPER STICK

CROSS-REFERENCES TO RELATED APPLICATIONS

This is a division of application Ser. No. 07/504,308, filed Apr. 6, 1990, now U.S. Pat. No. 5,071,310, which is a continuation-in-part of application Ser. No. 07/480,553, filed Feb. 15, 1990, now U.S. Pat. No. 4,952,116, which is a division of application Ser. No. 07/337,749, filed Apr. 13, 1989, now U.S. Pat. No. 4,950,127.

TECHNICAL FIELD

The present invention relates generally to the boom arms or, as they are generally known in the trade, "dipper sticks," which carry a bucket or other work implement used by backhoes and excavators, and more particularly, to a dipper stick which is selectively rotatable about its longitudinal axis.

BACKGROUND OF THE INVENTION

Backhoes, excavators and similar types of vehicles have an articulated arm assembly with a boom arm pivotally connected to the vehicle and a dipper stick pivotally attached to the boom arm at an end remote from the vehicle. The arm assembly has a bucket or other work implement pivotally attached at the free end of the dipper stick. Generally, the articulated arm assembly is pivotally connected to the vehicle so that the arm assembly can be rotated about a vertical axis relative to the vehicle, or is attached to a cab with the cab and arm assembly being rotatable as a unit about a vertical axis relative to the vehicle undercarriage. The bucket is pivotally attached to the dipper stick by a clevis which serves as a pivot point for the bucket relative to the dipper stick. The bucket is rotatable about the dipper stick pivot point in a generally vertical plane containing the boom arm and the dipper stick. While the entire articulated arm assembly can be rotated relative to the vehicle, the dipper stick and attached bucket cannot be rotated about the longitudinal axis of the dipper stick. Thus, the dipper stick and attached bucket cannot be rotated independent of the boom arm.

There are occasions, however, when it is very desirable to be able to rotate the dipper stick and hence the bucket, or other work implement attached to the dipper stick, independent of the boom arm so that the bucket can work along a cut line out of the plane containing the boom arm and the dipper stick. This allows an operator to dig an offset ditch, such as a ditch running along a straight cut line at a distance to the side of the vehicle, without moving the vehicle. Of course, when digging such a ditch it is desirable to keep the bucket in alignment with the cut line at all times to provide a ditch having the precise width of the bucket being used. Without being able to rotate the dipper stick about its longitudinal axis, the vehicle must be aligned so that the plane containing the boom arm and the dipper stick is in coincidence with the cut line. It was not possible to park the vehicle off to the side of the ditch and spaced away from the cut line, such as is sometimes desirable, and dig a narrow ditch along the cut line.

Being able to rotate the dipper stick also allows the operator much greater flexibility in the cut being made by the bucket in other situations and minimize the number of vehicle moves necessary to accomplish the cut desired. One example is the digging of a box hole with a square corner where the bucket must dig from two directions at right angles to each other to make a clean corner cut. Another example is digging around piles and other obstacles, or digging several ditches at different angles, such as a main and branch water supply or drainage ditches. It is very desirable to be able to complete such cuts without moving the vehicle. Being able to rotate the dipper stick enables the operator to perform such digging jobs with little or no movement of the vehicle, and also to lift or manipulate objects, such as rocks or slabs from all angles without moving the vehicle. The ability to rotate the dipper stick allows the operator to conveniently perform additional jobs, such as rotating the dipper stick in one direction to pick up material, and then rotating the dipper stick by 180° or as desired and extend the articulated arm to deliver the material to another place. Similar advantages are achieved when using other work implements attached to the dipper stick.

The increased versatility noted above has been realized with the advent of the rotatable dipper stick. In the past, such rotatable dipper stick units have utilized a dipper stick with a boom attachment head comprising a large turntable bearing with a ring gear machined into the perimeter of the rotatable turntable bearing member. A hydraulic motor with a pinion gear in engagement with the turntable gear provided the rotational drive. A brake was used to stop the rotational movement when desired and to hold the rotational position of the turntable bearing member while the dipper stick was in use such as with a bucket digging. This arrangement is bulky, heavy and lacks precision control both during rotation of the dipper stick and when being held in position while work is being performed. The resulting dipper stick assembly is much larger than a conventional non-rotatable dipper stick and larger than desirable for all but the largest excavation vehicles. Further, such a design arrangement cannot be reduced in size for use in the smaller sized dipper sticks necessary for smaller-sized backhoes and excavators. While such rotatable dipper sticks have existed for several years, the drive mechanisms used have not provided optimum results.

Since the dipper stick is rotatable relative to the boom, preferably by 360° or more, entanglement of hydraulic oil lines becomes a problem. It has thus become necessary to design new ways of providing hydraulic oil to the dipper stick and the bucket or other work implement attached thereto which allow free rotation of the dipper stick unimpeded by hydraulic oil hoses, and avoids the possibility of loops of hoses catching on things when in use.

It will therefore be appreciated that there has been a significant need for a rotatable dipper stick rotated by a mechanism able to transmit a large torque to the dipper stick and firmly hold the dipper stick in the desired rotational position even under large work loads. Preferably, the rotatable dipper stick should be rotatable through more than 360°. The rotatable dipper stick should be smaller and lighter than those presently available, and fit within the normal dimensional envelope of presently existing conventional non-rotatable dipper sticks. The rotatable dipper stick should also be effectively and economically manufacturable in small as well as large sizes. Moreover, the rotatable dipper stick should have a precision rotational drive mechanism capable of precise positional control and able to hold its rotational position without the use of a separate brake mechanism which can slip or rail. The rotatable dipper stick should also be able to operate without failure when subjected to large side loads. Also, a new means of porting hydraulic oil to the rotating dipper stick and the work implement should be used which avoids entanglement and snagging of hoses. The present invention fulfills these needs and further provides other related advantages.

DISCLOSURE OF THE INVENTION

The present invention resides in a vehicle having a fluid-powered, rotary dipper stick assembly mounted to a boom arm of the vehicle. The vehicle includes a selectively operable dipper stick actuator associated with the boom arm for rotation of the dipper stick assembly through a boom plane containing the boom arm.

The dipper stick assembly has a work implement, such as a bucket, and a selectively operable work implement actuator associated therewith for operation of the work implement. It is noted that the invention may also be practiced by the manufacture of a dipper stick assembly not including the vehicle, boom arm or dipper stick actuator. Similarly, the invention may be practiced by the manufacture of the dipper stick assembly without the work implement attached thereto. The particular form the invention takes depends upon whether a backhoe, excavator or other type of vehicle using the dipper stick assembly is being sold as original equipment or whether the dipper stick assembly is being sold as a retrofit product for existing vehicles.

The dipper stick assembly of the present invention includes a boom attachment head having a first attachment portion attachable to the vehicle boom arm, and a second attachment portion attachable to the dipper stick actuator to provide pivotal movement of the boom attachment head through the boom plane upon actuation of the dipper stick actuator. In a preferred embodiment of the invention, the first and second attachment portions are selectively detachable from the boom arm and the dipper stick actuator.

The dipper stick assembly further includes a work implement attachment head having a third attachment portion attachable to the work implement to operate the work implement upon actuation of the work implement actuator. Preferably, the third attachment portion is selectively detachable from the work implement.

An elongated, generally cylindrical outer body having a longitudinal axis extends substantially fully between the boom attachment head and the work implement attachment head, with a first body end toward the boom attachment head and a second body end toward the work implement attachment head. The body is rigidly attached to the work implement attachment head and has a fourth attachment portion spaced away from the work implement attachment head and attachable to the work implement actuator to apply a counterforce upon actuation of the work implement actuator to operate the work implement.

In a preferred embodiment, an elongated, generally cylindrical axle is disposed within the body with an outward wall portion thereof positioned immediately adjacent to an inward wall portion of the body. The axle has first and second axle ends and extends therebetween at least in part longitudinally within the body in generally coaxial arrangement therewith. The first axle end is positioned outward of the body beyond the first body end and the axle extends from the first axle end into the first body end to the second axle end which is positioned toward a midportion of the body between the first and second body ends. The axle has a first end portion located toward the first axle end which is attached to the boom attachment head to prevent relative rotational movement therebetween. The body is selectively rotatable relative to the axle about the body longitudinal axis, but restrained against longitudinal movement relative to the axle. At least the outward wall portion of the axle toward the first body end is in engagement with the inward wall portion of the body and at least the outward wall portion of the axle toward the second axle end is in engagement with the inward wall portion of the body at the body midportion. The outward wall portions of the axle toward the first body end and the second axle end are spaced apart by a sufficient distance to provide increased stability against forces generated during use of the dipper stick assembly tending to move the body out of coaxial alignment with the axle.

Means for producing rotational movement of the body relative to the axle is provided. In one embodiment, a linear-to-rotary transmission means is disposed within the body and is operable for producing rotational movement of the body relative to the axle. The transmission means includes a piston for the selective application of fluid pressure to one or an other side thereof to produce linear movement of the piston within the body selectively toward the first and second body ends, and means for translating linear movement of the piston toward one of the first or second body ends into clockwise relative rotational movement between the body and the axle and translating linear movement of the piston toward the other of the first or second body ends into counterclockwise relative rotational movement between the body and the axle to selectively rotate the work implement attachment head and hence the work implement about the body longitudinal axis independent of the boom attachment head and hence the boom arm. As such, the dipper stick assembly is capable of handling significantly increased loads without interfering with the operation of the linear-to-rotary transmission means such as can occur on misalignment. In another embodiment, the means for producing rotational movement is a hydraulic motor.

The rotary dipper stick assembly includes a rotary thrust bearing positioned toward the first body end to transmit thrust loads on the body in both directions along the body longitudinal axis to the boom attachment head while permitting rotation of the body relative to the axle and restraining relative longitudinal movement between the body and the axle.

In one embodiment, the rotary thrust bearing includes first and second bearing members rotatable relative to each other and transmitting thrust loads on the body in both longitudinal directions therebetween. The first bearing member is non-rotatable relative to the axle and rigidly connected to the boom attachment head or the axle. The second bearing member is rotatable relative to the axle and rigidly connected to the body.

The rotary dipper stick assembly is usable with a vehicle providing fluid supply lines terminating at about the attachment head. The non-rotating first bearing member has a plurality of fluid passageways therein for the connection of the fluid supply lines thereto, and each of the fluid passageways is positioned for continuous fluid communication with a corresponding one of a plurality of ports in the rotating second bearing member as the body rotates. The assembly further includes fluid seals positioned between the first and second bearing members to prevent leakage of fluid as the fluid is communicated between corresponding ones of the first bearing member fluid passageways and the second bearing member ports.

One or the other or both of the first and second bearing members has formed in a surface portion thereof a plurality of channels which extend circumferentially fully thereabout. Each channel is in fluid communication with one of the first bearing member fluid passageways and longitudinally positioned to be in continuous fluid communication with one of the second bearing member ports as the second bearing member rotates.

In another embodiment of the rotary thrust bearing, one of the first or second bearing members has a radially projecting, circumferentially extending flange and the other has an opening receiving the flange. The opening is defined by first and second longitudinally spaced apart members which engage the flange to substantially inhibit longitudinal movement of the flange under thrust loading on the body in either longitudinal direction.

In one embodiment of the rotary dipper stick assembly usable with a vehicle providing fluid supply lines terminating at about the attachment head, the non-rotating axle has a plurality of longitudinally extending fluid passageways therein for the connection of the fluid supply lines thereto. Each of the axle fluid passageways is positioned for continuous fluid communication with a corresponding one of a plurality of ports in a sidewall of the body as the body rotates. The assembly further includes fluid seals positioned between the axle and the body sidewall to prevent leakage of fluid as the fluid is communicated between corresponding ones of the axle fluid passageways and body sidewall ports.

The rotary dipper stick assembly includes an additional longitudinally extending fluid passageway in the axle positioned to communicate fluid directly from one of the fluid supply lines to within the body to a side of the piston toward the first body end for linear movement of the piston toward the second body end.

In one embodiment, the axle has formed in a surface portion thereof longitudinally inward of the first body end a plurality of radially outward opening channels, which extend circumferentially fully about the axle. Each of the channels is in fluid communication with one of the axle fluid passageways and longitudinally positioned on the axle to be in continuous fluid communication with one of the body sidewall ports as the body rotates.

In one embodiment, the axle includes an interiorly splined axle recess toward the second axle end and the body includes an interiorly splined body member toward the second body end. The piston has an exteriorly splined first end portion disposed within the splined axle recess and an exteriorly splined second end portion disposed within the splined body member. A piston head is located between the first and second piston end portions in sliding engagement with an interior surface of the body to define a fluid tight chamber to each side of the piston head.

Other features and advantages of the invention will become apparent from the following detailed description, taken in conjunction with the accompanying drawings.

BRIEF DESCRIPTION OF THE DRAWINGS

FIG. 4 is a fragmentary, side elevational view of the external hydraulic fluid ports on the outer bearing block of the rotary dipper stick of FIG. 4.

FIG. 7 is a top plan view of the rotary dipper stick of FIG. 6.

FIG. 8 is a bottom plan view of the rotary dipper stick of FIG. 6 without the hydraulic motor illustrated.

BEST MODE FOR CARRYING OUT THE INVENTION

Figure 1:
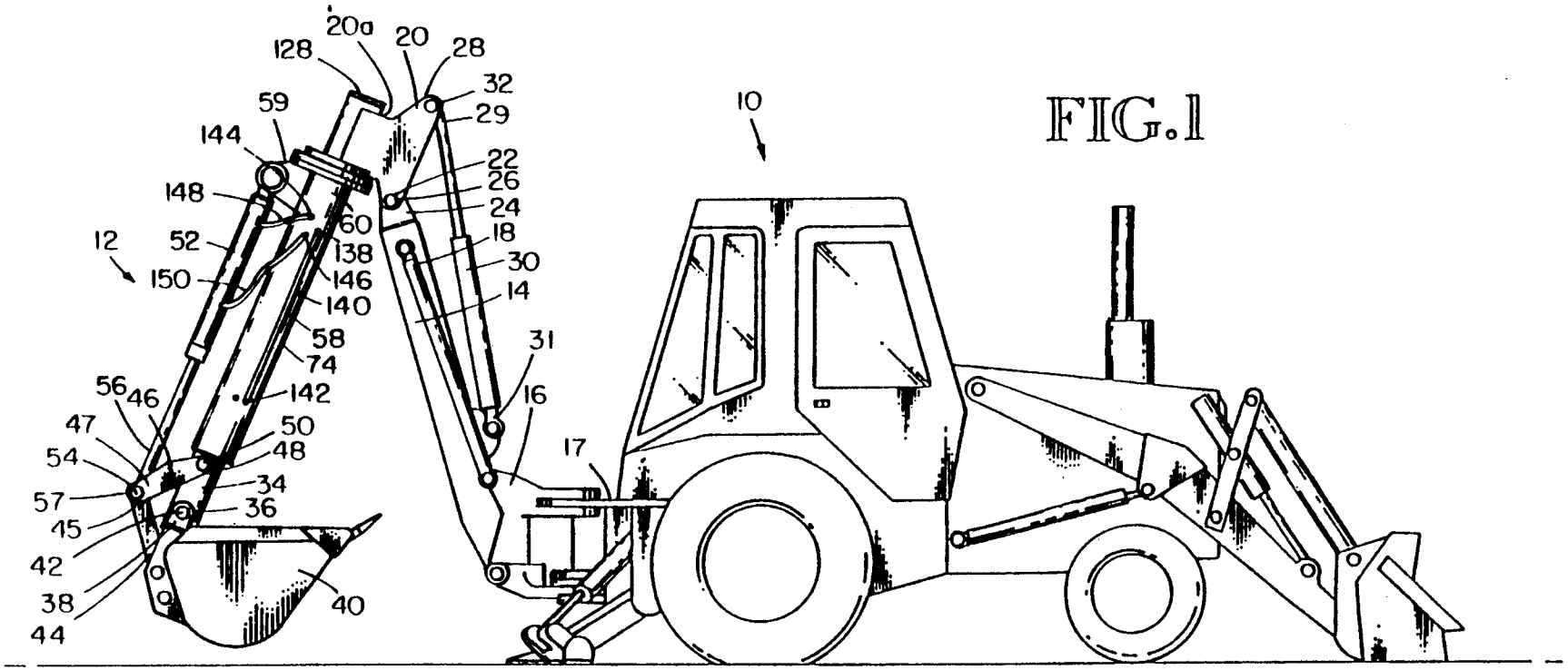
FIG. 1 is a side elevational view of an excavator shown with a rotary dipper stick assembly embodying the present invention.

As shown in the drawings for purposes of illustration, the present invention is embodied in a vehicle, indicated generally by reference numeral 10, having a fluid-powered, rotary dipper stick assembly 12. The vehicle 10 may be a backhoe, as illustrated in FIG. 1, or any other type of excavator or other vehicle that might utilize a rotary dipper stick. As best shown in FIG. 1, the vehicle 10 has a boom arm 14 which is pivotally connected by one end to a base member 16. In the illustrated backhoe, the base member 16 is pivotally connected to a vehicle frame 17 for pivotal rotation about a vertical rotational axis. A pair of hydraulic cylinders 18 (only one being shown in FIG. 1) are provided for raising and lowering the boom arm 14 relative to the base member 16 and pivotal movement of the boom arm through a generally vertical boom plane. Other vehicles, particularly large excavators utilizing the invention, may have an articulated boom arm having two arms pivotally and even laterally rotationally connected together, with the rotary dipper stick assembly 12 attached at the end of the arm remote from the vehicle frame.

The rotary dipper stick assembly 12 includes a boom attachment head 20 having a first clevis 22 by which an attachment end 24 of the boom arm 14 remote from the base member 16 is attached to the boom attachment head using a removable pivot pin 26. The boom attachment head 20 further includes another clevis 28 separated from the first clevis 22 by which an attachment end 29 of a hydraulic cylinder 30 is attached to the boom attachment head using a removable pivot pin 32. An opposite attachment end 31 of the hydraulic cylinder 30 is attached to the boom arm 14. The hydraulic cylinder 30 is selectively operable to pivotally move the boom attachment head 20 through the boom plane upon actuation of the hydraulic cylinder 30. It is to be understood that in situations where the boom arm is comprised of two arms and they are connected together in a manner that allows some lateral rotation between them, the boom plane may be defined in the vertical plane through which the arm remote from the vehicle frame is pivoted.

The rotary dipper stick assembly 12 further includes a bucket attachment head 34 having a first pivot pin aperture 36 by which a clevis 38 of a conventional digging bucket 40 is connected to an end of the bucket attachment head remote from the boom attachment head 20 using a removable pivot pin 42. A rotation link 44 is pivotally connected through an interconnecting link 46 to a second pivot pin aperture 48 of the bucket attachment head 34 using a removable pivot pin 50. A hydraulic cylinder 52 is provided for rotation of the bucket 40 through a dipper stick plane containing the boom attachment head 20 and the bucket attachment head 34 upon actuation of the hydraulic cylinder 52. An end portion 45 of the rotation link 44 and an end portion 47 of the interconnecting link 46 each has a transverse aperture 54 therethrough for connection to an end portion 56 of the hydraulic cylinder 52 using a pivot pin 57.

By the use of removable pivot pins, the boom attachment head 20 can be conveniently removed from the boom arm 14, and when manufactured as a retrofit item, the rotary dipper stick assembly 12 can be conveniently attached to a conventional boom arm without modification required. Further, the bucket 40 can be conveniently removed and replaced with a larger-sized bucket or another style of work implement of conventional design.

Figure 2:
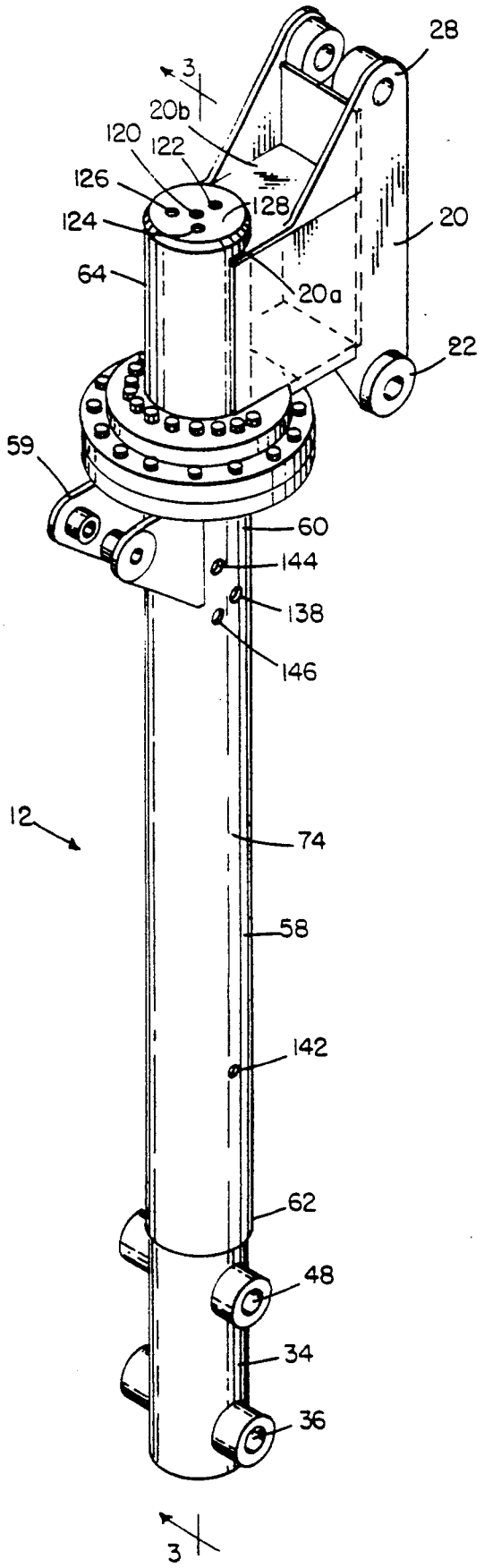
FIG. 2 is an enlarged perspective view of the rotary dipper stick of FIG. 1 shown detached from the boom arm of the excavator and with the bucket detached from the rotary dipper stick.
Figure 3:
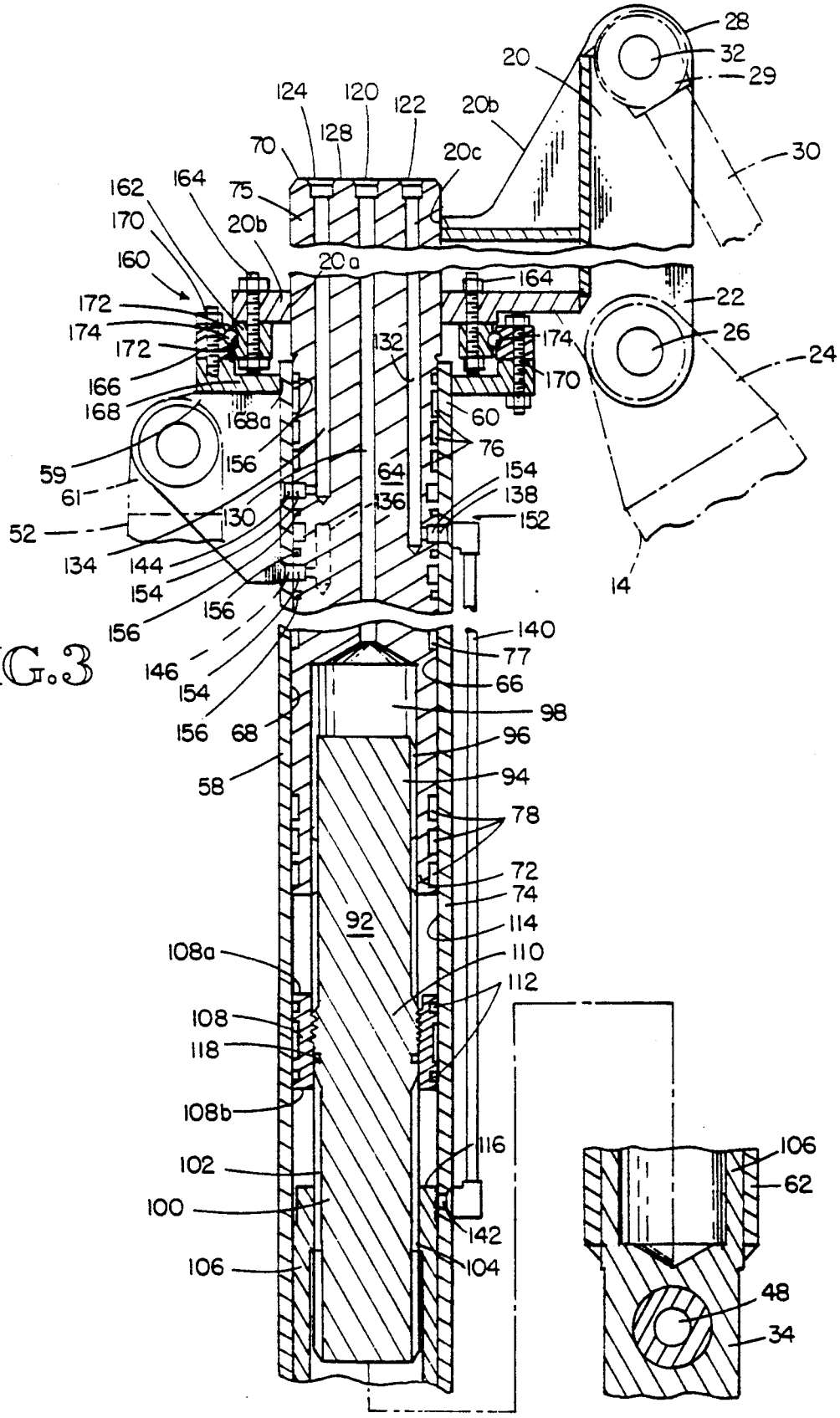
FIG. 3 is an enlarged, fragmentary, side elevational cross-sectional view taken substantially along the line 3—3 of FIG. 2.

In the first embodiment of the invention shown in greater detail in FIGS. 2 and 3, the rotary dipper stick assembly 12 includes an elongated, generally cylindrical outer housing or body 58 having a longitudinal central axis and extending fully between the boom attachment head 20 and the bucket attachment head 34. The body 58 has a first body end 60 positioned toward the boom attachment head 20, and a second body end 62 positioned toward the bucket attachment head 34. The body 58 is rigidly connected to the bucket attachment head 34 at the second body end 62. The body 58 is rotatable about its longitudinal axis relative to the boom attachment head 20, and rotation of the causes rotation of the bucket attachment head 34 and the bucket 40 about the body longitudinal axis independent of the boom arm 14, as will be described in more detail below.

An elongated, generally cylindrical axle 64 is partially disposed within the body 58 with an outward wall portion 66 thereof positioned immediately adjacent to an inward wall portion 68 of the body and in supporting sliding engagement therewith. The axle 64 has a first axle end 70 positioned outward beyond the first body end 60, and extends into the body 58 at this first body end 60 to a second axle end 72 positioned toward a midportion 74 of the body 58 located between the first and second body ends 60 and 62. The axle 64 extends longitudinally within the body 58 in a generally coaxial arrangement therewith. A first axle end portion 75 extends outward beyond the first body end 60, through an aperture **20*a* in a generally annular support plate 20*b* of the boom attachment head 20 to the first axle end 70. The first end portion 75 is received in a saddle 20*c* in a support member 20*d* of the boom attachment head 20. The first axle end portion 75 is welded to the support plate 20*b* at the aperture 20*a* and to the support member 20*d* within the saddle 20*c*, and thus is stationary relative to the boom attachment head 20. As such, the body 58 with the bucket attachment head 34 rigidly attached thereto, is selectively rotatable about the body longitudinal axis relative to the axle 64 which is rigidly attached to the boom attachment head 20. This ability to rotate the body 58 and bucket 40 independent of the boom arm 14 increases the versatility of the vehicle 10** compared to conventional non-rotatable dipper stick assemblies.

A plurality of first radial bearings 76 are disposed between the inward wall portion 68 of the body 58 and the outer wall portion 66 of the axle 64 toward the first body end 60. A plurality of second radial bearings 78 are similarly disposed between the inward wall portion 68 of the body 58 and the outward wall portion 66 of the axle 64 toward the second axle end 72. A plurality of third radial bearings 77 are similarly disposed, at a longitudinal location between the first and second radial bearings. The first and second axle ends 70 and 72, and also the location of the first and second radial bearings 76 and 78 are spaced apart by a sufficient distance to provide increased stability to the body 58 against forces such as the large side load which may be generated during use of the dipper stick assembly 12 and tend to move the body out of its proper alignment.

A clevis 59 is rigidly attached to an outward wall portion of the body 58 at the first body end 60 so as to be spaced away from the bucket attachment head 34 for attachment thereto of an attachment end 61 of the hydraulic cylinder 52. The clevis 59 supplies a counterforce upon actuation of the hydraulic cylinder 52 to pivotally move the bucket 40 through the dipper stick plane.

The rotational movement of the body 58 relative to the axle 64 is accomplished using a linear-to-rotary transmission arrangement disposed within the body 58. The linear-to-rotary transmission arrangement is shown in FIG. 3 and includes a floating piston 92 which is reciprocally disposed within the body 58 at its midportion 74 and extends longitudinally within the body in generally coaxial arrangement therewith. The piston 92 has a first end portion 94 with exterior helical splines 96 which is coaxially received within an interiorly helically splined recess 98 of the axle 64 at the second axle end 72. The piston 96 also has a second end portion 100 with exterior helical splines 102 which is coaxially received within an interiorly splined recess 104 of an insert portion 106 of the bucket attachment head 34 which projects into the body 58 at the second body end 62. The insert portion 106 is welded to the body 58. The inner helical splines of the axle recess 98 mesh with the corresponding exterior helical splines 96 of the piston first end portion 94. Similarly, the inner helical splines of the insert portion recess 104 mesh with the corresponding exterior helical splines 102 of the piston second end portion 100. Reciprocation of the piston 92 causes rotation of the body 58 relative to the axle 64 in a conventional manner for fluid-powered helical rotary actuators.

The piston 92 has an annular piston head 108 threadably attached at a midportion 110 of the piston with conventional seals 112 to provide a fluid-tight seal between the piston head and a smooth inward wall portion 114 of the body 58 at its midportion 74. The smooth inward wall portion 114 has sufficient length to accommodate the full stroke of the piston between the second axle end 72 and an end 116 of the insert portion 106. A conventional seal 118 provides a fluid-tight seal between the piston head 108 and the piston midportion 110. The piston 92 is slidably retained within the body 58 for reciprocal movement therewithin in response to the application of hydraulic fluid to one or the other sides of the piston head 108, as will be described below.

Hydraulic fluid supply lines (not shown) from a hydraulic pump (not shown) mounted on the vehicle frame 17, terminate at the stationary boom attachment head 20. This hydraulic fluid must be supplied to the hydraulic cylinder 52 to operate the bucket 40 and to both sides of the piston head 108 disposed within the body midportion 74. However, the bucket hydraulic cylinder 52 and the body 58 rotate relative to the stationary axle 64 and boom attachment head 20. Thus, it is necessary to conduct hydraulic fluid a long distance and between parts that rotate relative to each. Two hydraulic fluid supply lines (not shown) for control of the piston 92 are connected to ports 120 and 122, and two hydraulic fluid supply lines (not shown) for control of the bucket hydraulic cylinder 52 are connected to ports 124 and 126. As best shown in FIG. 2, the ports 120, 122, 124, and 126 are formed in an outer end face 128 of the axle 64.

The axle 64 is constructed of solid steel from its end face 128 to the axle recess 98, and four hydraulic fluid passageways 130, 132, 134, and 136 are bored therein. The passageways extend longitudinally within the axle, with the passageway 130 extending from the port 120 downward in a straight line directly into the axle recess 98 to supply hydraulic fluid to a first side 108*a* of the piston head 108. The passageway 132 extends downward from the port 122 in a straight line and turns radially outward to communicate with a port 138 in the wall of the body 58. The port 138 is connected by a hydraulic fluid line 140 to a port 142 in the wall of the body 58 toward the second body end 62 positioned to supply hydraulic fluid to a second side 108*b* of the piston head 108. Similarly, the passageways 134 and 136 extend downward in a straight line from the ports 124 and 126, respectively, and each turn radially outward to communicate with ports 144 and 146, respectively, in the wall of the body 58. The port 144 is connected by a hydraulic fluid line 148 and the port 146 is connected by a hydraulic fluid line 150 to the bucket hydraulic cylinder 52, as shown in FIG. 1.

Since the body 58 rotates relative to the axle 64, the passageways 132, 134, and 136 rotate relative to the ports 138, 144, and 146. To accommodate this relative rotational movement, an oil-tight rotary joint, indicated generally by reference numeral 152, is provided. The rotary joint 152 includes three longitudinally spaced apart, circumferentially extending grooves 154 in the surface of the axle 64 which conduct the hydraulic fluid, one being positioned at the terminus of each of the passageways 132, 134, and 136 and in fluid communication with the corresponding passageway. The ports 138, 144, and 146 which communicate with the passageways are positioned in the wall of the body 58 such that each will be in fluid communication with the corresponding groove 154 at all rotary positions of the body 58 as it rotates relative to the axle 64. Conventional seals 156 between the axle 64 and the inward wall of the body 58, positioned to both longitudinal sides of each groove 154 provide a fluid-tight seal to prevent leakage of hydraulic fluid to the interior of the body or between the grooves as the body rotates. Additional passageways and ports can be added, and the rotary joint enlarged if needed for connection of auxiliary equipment to the bucket attachment head or if different equipment is used which needs more hydraulic fluid lines for operation.

The present invention permits hydraulic fluid to be supplied to the bucket hydraulic cylinder 52 and the piston 92 in a manner that will permit uninhibited rotation of the body 58 relative to the boom attachment head without the use of swivel joints that can leak or loops of hydraulic lines that can be come entangled with other parts of the vehicle 10 or snagged on objects in the vicinity of the vehicle as the dipper stick assembly 12 is operated.

Reciprocation of the piston 92 occurs when hydraulic fluid under pressure enters the port 120 to the first side 108*a* of the piston head 108, or the port 122 to the second side 108*b* of the piston head. A fluid-tight compartment exists to each side of the piston head 108, with each of the ports 120 and 122 in fluid communication with one of the compartments. As the piston 92 linearly reciprocates along the longitudinal body axis, the meshing of the splines 96 and 102 of the piston with the corresponding splines of the axle recess 98 and the insert recess 104 cause the body 58 to rotate relative to the axle 64.

In particular, fluid pressure applied to either side of the piston head 108 causes the piston 92 to move linearly and rotate as a result of the exterior splines 96 of the piston first end portion 94 meshing with the interior splines of the axle recess 98. This linear and rotational movement of the piston 92 is transmitted through the exterior splines 102 of the piston second end portion 100 to the interior splines of the insert portion recess 104 and thus to the body 58 fixedly attached thereto. Since the axle 64 is held stationary with respect to the boom attachment head 20, rotation of the body 58, and hence the bucket attachment head 34 and the bucket 40 attached thereto, results. Depending on the slope and direction of turn of the various helical splines chosen, there may be provided a multiplication or reduction of the relative rotation between the body 58 and the axle 64 and a desired torque.

Since side loads and other forces encountered during use of the rotary dipper stick assembly 12 to dig can cause misalignment of the splines of the axle recess 98, the piston 92 and the insert portion recess 104, it is important to maintain the proper coaxial alignment of the body 58 and the axle 64. This is facilitated by the axle 64 slidably supporting the body 58 along the first body end 60 to its midportion 74. With this arrangement, the dipper stick assembly 12 has the capability of handling significantly increased side loads without interfering with the operating of the linear-to-rotary transmission arrangement that can occur if the body 58 should become misaligned with the axle 64.

The sensitivity to side loading is also somewhat reduced by use of a turntable thrust bearing 160 connected between the stationary boom attachment head 20 and the rotating body 58. The thrust bearing, however, primarily provides support against thrust loads on the dipper stick assembly 12 in both longitudinal directions and keeps the body 58 rotatably connected to the boom attachment head 20. The thrust bearing 160 has a stationary inner bearing block 162 rigidly attached to the support plate 20*b* of the boom attachment head 20, concentric with the support plate aperture 20*a*, by a plurality of bolts 164. The thrust bearing 160 also includes a rotatable outer bearing block 166 rigidly attached to an annular flange 168 by a plurality of bolts 170. The flange 168 has an aperture 168*a* through which the first body end 60 of the body 58 extends. The body 58 is welded to the flange 168 at the aperture 168*a*, and thus the flange of the outer bearing block and the body are held stationary relative to each other.

The inner and outer bearing blocks 162 and 166 each have a circumferential ball bearing race 172 formed therein corresponding to and confronting the race of the other bearing block to form a ball channel, and a plurality of ball bearings 174 are seated in the ball channel to permit free rotation of the rotatable outer bearing block 166 and hence the body 58, relative to the stationary inner bearing block 162 and hence the boom attachment head 20. The ball bearings 174 provide support against movement of the body 58 along its longitudinal axis, in either longitudinal direction under thrust loading, without transmitting the thrust loads through the linear-to-rotary transmission arrangement which is free to function as a rotary actuator. In other words, thrust loads on the body 58 in both longitudinal directions are transmitted directly to the boom attachment head 20 without being transmitted through the axle 64 or the splined components that convert reciprocation of the piston 92 into rotation of the body 58. This is accomplished with the axle 64 extending only partially through the body 58.

With the rotary dipper stick assembly 12 of the present invention, a rotary dipper stick can be manufactured in a variety of sizes fitting within the normal dimensional envelope of presently existing conventional non-rotatable dipper sticks. Further, the rotary dipper stick assembly 12 incorporates as an integral part of its design a fluid-powered actuator which required far less space and is lighter than the rotatable dipper sticks presently on the market which use a ring gear machined into a rotatable turntable bearing member, a hydraulic motor with a pinion gear to engage the ring gear and drive the turntable, and a separate brake to stop the rotational movement of the turntable when desired and hold the rotational position of the turntable when the dipper stick is being used dig.

The fluid-powered actuator design incorporated into the rotary dipper stick assembly 12 of the present invention provides the benefits of a high-torque and high-efficiency fluid-powered device using a simple linear piston and cylinder drive arrangement. Thus, high torque can be achieved from a relatively small mechanism, and precision positional control is achieved without the need for a separate brake mechanism. Once the body 58 and the bucket 40 attached thereto have been rotated to a desired rotational position, fluid is applied to both ports 120 and 122 to hold the piston 92 stationary within the body 58 and unable to move in either longitudinal direction. This also holds the body 58 stationary relative to the axle 64, and hence the bucket 40 is held firmly locked against undesirable rotation about the body longitudinal axis while the bucket is being used to dig. The present invention avoids the necessity for a separate brake mechanism which can slip or fail. The precise control is achieved by simply metering the fluid applied to the piston head 108.

The illustrated embodiment of the rotary dipper assembly 12 shown in FIGS. 1-3 produces 75,000 inch-pounds of torque when operated using hydraulic fluid at 3,000 pounds per square inch. In this embodiment the body 58 and the bucket 40 are rotatable through 425°.

To permit the unimpeded 360° full rotation of the body 58 about the body longitudinal axis, the support plate **20*b* projects outwardly away from the first clevis 22 at which the boom arm 14 is attached by a sufficient distance to avoid the clevis 59 contacting the boom arm as it rotates with the body 58**.

Figures 4, 5:
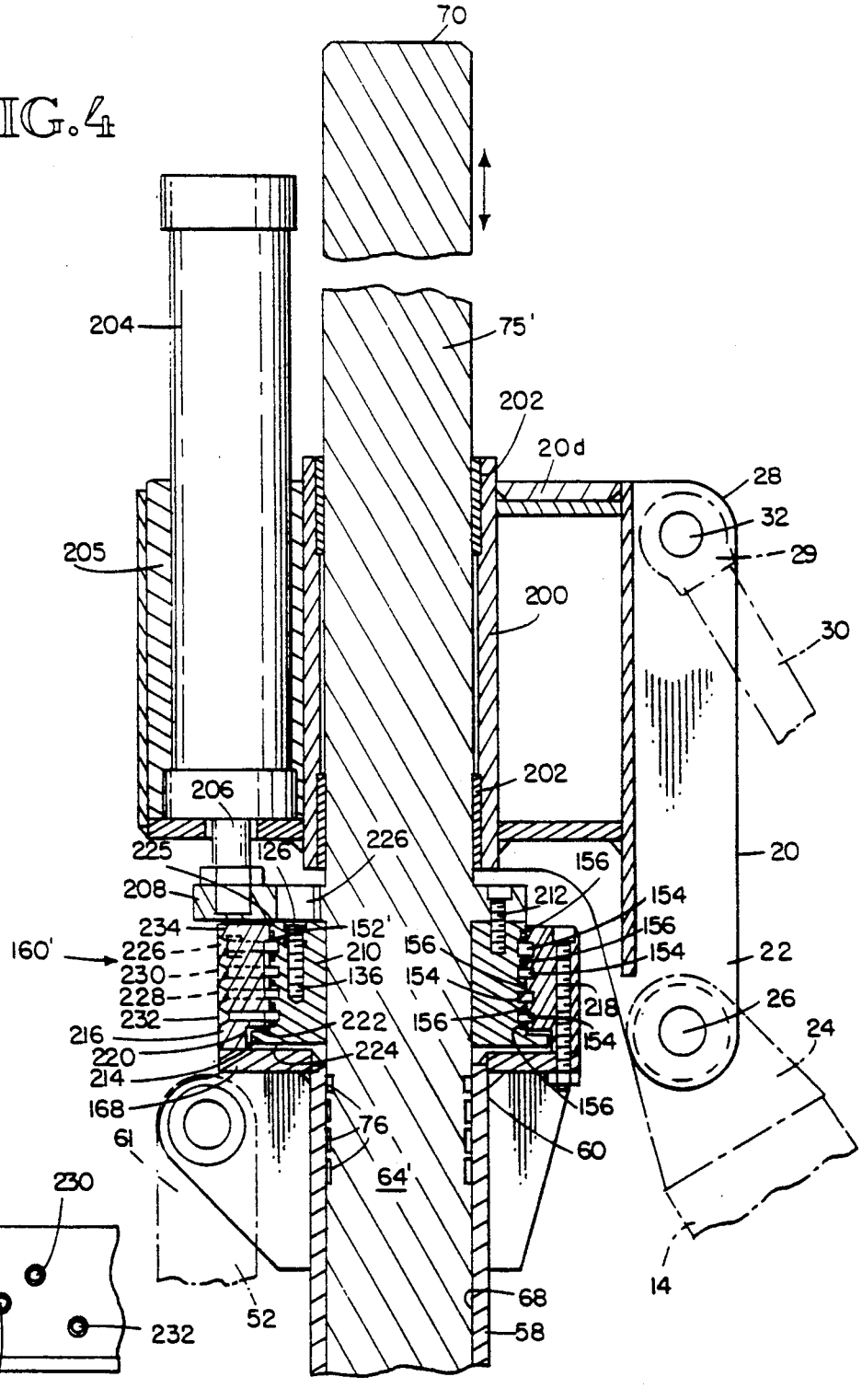
FIG. 4 is a fragmentary, side elevational cross-sectional view of a second embodiment of the rotary dipper stick of FIG. 1.

A second embodiment of the dipper stick assembly 12 very similar to the assembly of FIGS. 1-3, is shown in FIGS. 4 and 5. For ease of understanding, the components of the alternative embodiments of the invention described below have been similarly numbered with those of the first embodiment when of a similar construction. Only the more significant differences in construction will be described in detail.

One such difference in the embodiment of FIG. 4 is the use of an axle 64' which is longitudinally extendable relative to the boom attachment head 20, rather than being fixedly attached thereto, although the axle is still held so that it does not rotate relative to the boom attachment head as the body 58 is rotated. The axle 64' has a first axle end portion 75' slidably disposed in a tubular member 200 which is rigidly attached to the support member **20*d*. The tubular member 200 has interior slide bearings 202 to reduce friction. A hydraulic cylinder 204 is fixedly attached to the support member 20*d* by a bracket 205 and has an extendable arm 206 which is connected to a flange 208 of the axle end portion 75'**.

When the hydraulic cylinder 204 is actuated to extend the arm 206, the axle end portion 75' slides within the tubular member 200 in a direction towards the bucket 40. The axle 64' and the body 58 are moved as a unit longitudinally along the body longitudinal axis. Hence, the bucket 40 attached to the bucket attachment head 34 is longitudinally extended. When the hydraulic cylinder 204 is actuated to retract the arm 206, the axle end portion 75' again slides within the tubular member 200, but in the direction away from the bucket 40, and the axle 64' and the body 58 are moved are a unit longitudinally. Hence, the bucket 40 is longitudinally retracted. This provides additional versatility to the rotary dipper stick assembly 12.

With this second embodiment, a thrust bearing 160' is used which has a non-rotating inner bearing block 210 rigidly attached to the axle flange 208 by a plurality of bolts 212. The inner bearing block 210 has a radially outward projecting bearing flange 214. The thrust bearing 160' also includes a rotatable outer bearing block 216 rigidly attached to the flange 168 by a plurality of bolts 218. As described above for the first embodiment, the flange 168 is welded to the body 58, and thus held stationary relative to the body. When bolted in position to the flange 168, the outer bearing block 216 and the flange define a radially inward opening 220 therebetween which receives the bearing flange 214 of the inner bearing block 210.

A ring 222 of low friction material is positioned between an annular upper surface of the bearing flange 214 and a corresponding annular surface of the outer bearing block 216 to transmit thrust loads on the body 58 along the longitudinal axis of the body in the direction toward the second body end 62, to the axle 64' and hence through the hydraulic cylinder 204 to the boom attachment head 20. A ring 224 of low friction material is positioned between an annular lower surface of the bearing flange 214 and a corresponding annular surface of the flange 168 to transmit thrust loads on the body 58 along the longitudinal axis of the body in the direction toward the first body end 60, to the axle 64' and hence through the hydraulic cylinder 204 to the boom attachment head 20. Thus, the thrust bearing 160' provides support against movement of the body 58 longitudinally along its longitudinal axis, in either longitudinal direction under thrust loading, without transmitting the thrust loads through the linear-to-rotary transmission arrangement used to rotate the body 58 relative to the axle 64'.

With this second embodiment of the invention, the use of hydraulic fluid passageways in the axle are not as desirable, although the problem still exists of supplying hydraulic fluid from supply lines which terminate at the boom attachment head 20 to the rotating body 58 and bucket 40 attached thereto. In this embodiment, the hydraulic fluid is transferred through the thrust bearing 160'. The ports 120, 122, 124, and 126 to which the hydraulic fluid supply lines (not shown) are connected for controlling the bucket hydraulic cylinder 52 and the piston 92 are formed in an upward facing annular surface 225 of the non-rotating inner bearing block 210 (only one such port 126 being shown in FIG. 4). Four apertures 226 are provided in the axle flange 208 to allow access to the ports 120, 122, 124, and 126 for connection of the hydraulic fluid supply lines thereto.

As does the axle 64 of FIGS. 1-3, the non-rotating inner bearing block 210 in this embodiment has the four hydraulic fluid passageways 130, 132, 134, and 136 formed therein (only one such passageway 136 being shown in FIG. 4). In this embodiment, each of the four passageways 130, 132, 134, and 136 is in fluid communication with one of four ports 226, 228, 230, and 232, respectively, formed in an upward projecting, circumferentially extending annular wall 234 of the outer bearing block 216. Two of these ports are longitudinally offset from the other two ports, and all of the ports are circumferentially spaced apart, as shown in FIG. 5. Hydraulic fluid lines (not shown) connect two of the ports 226, 228, 230, and 232 to the bucket hydraulic cylinder 52 and the other two of the ports to a pair of ports (not shown) in the wall of the body 58. The ports of the body 58 are located with one port to each side of the piston head 108. Since the outer bearing block 216 does not rotate relative to the body 58 and the bucket hydraulic cylinder 52, the lines can be run without large loops that can become entangled or snag objects as the rotary dipper stick assembly 12 is used.

As with the embodiment of FIGS. 1-3, this second embodiment uses a rotary joint 152' with circumferential fluid conducting grooves 154'. In this embodiment the grooves 154' are formed with half of each groove in the corresponding surfaces of the inner and outer bearing blocks 210 and 216. Conventional seals 156 are used to prevent fluid leakage between the grooves or to the outside. Since all four passageways 130, 132, 134, and 136 are connected to ports 226, 228, 230, and 232, the rotary joint 152' uses four grooves 154'.

Figure 6:
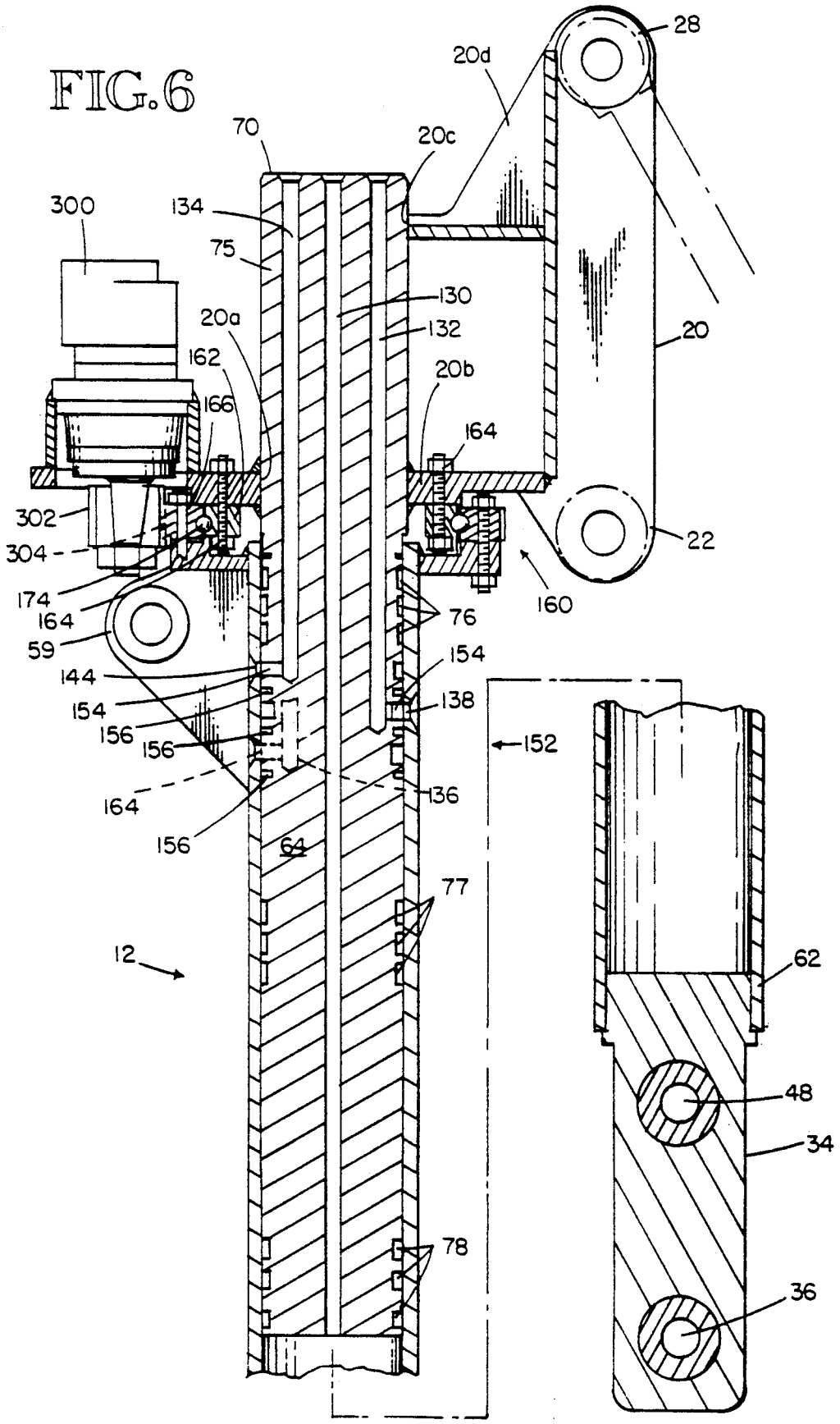
FIG. 6 is a fragmentary, side elevational cross-sectional view of a third embodiment of the rotary dipper stick of FIG. 1 using a hydraulic motor drive.

A third embodiment of the rotary dipper stick assembly 12, very similar to the assembly of FIGS. 1-3, is shown in FIGS. 6, 7, and 8. In this embodiment the body 58 is rotated relative to the axle 64 by a hydraulic motor 300 and uses no reciprocating piston within the body. The motor 300 includes a drive pinion gear 302 which meshes with gear teeth 304 form fully around the circumference of the outer bearing block 166 and provides rotary drive to the outer bearing block and hence the body 58. With this drive arrangement the body 58 may be continuously rotated clockwise or clockwise an unlimited amount since the degree of rotation possible is not limited by the stroke length of a piston in the body. The hydraulic motor 300 is supported by a bracket 306 attached to the support plate **20*b***.

With all embodiments of the invention, by the use of the single thrust bearing 160, thrust loads are not transmitted through the hydraulic motor 300 or the linear-to-rotary transmission arranged used. The use of the axle 64 to provide rigidity and support against side loading and other forces on the body 58 allows a smaller thrust bearing 160 to be used and hence the rotary dipper stick assembly 12 to be manufactured with a smaller, more compact size which is useful on small excavators where a larger turntable thrust bearing could not fit.

It will be appreciated, that although specific embodiments of the invention have been described herein for purposes of illustration, various modifications may be made without departing from the spirit and scope of the invention. Accordingly, the invention is not limited except as by the appended claims.

I claim:

1. A fluid-powered, rotary dipper stick assembly, usable with a vehicle having a boom arm and a selectively operable dipper stick actuator associated therewith for pivotal movement of the dipper stick assembly through a boom plane containing the boom arm, the dipper stick assembly being usable with a work implement such as a bucket having a selectively operable work implement actuator associated therewith, comprising:

a boom attachment head having a first attachment portion attachable to the vehicle boom arm, and a second attachment portion attachable to the dipper stick actuator to provide pivotal movement of said boom attachment head through the boom plane upon actuation of the dipper stick actuator, said first attachment portion and said second attachment portion being selectively detachable from the boom arm and the dipper stick actuator;

a work implement attachment head having a third attachment portion attachable to the work implement to operate the work implement upon actuation of the work implement actuator, said third attachment portion being selectively detachable from the work implement;

an elongated, generally cylindrical outer body having a longitudinal axis and extending substantially fully between said boom attachment head and said work implement attachment head, with a first body end toward said boom attachment head and a second body end toward said work implement attachment head, said body being rigidly attached to said work implement attachment head and having a fourth attachment portion spaced away from said work implement attachment head and attachable to the work implement actuator to apply a counterforce upon actuation of the work implement actuator to operate the work implement;

an elongated, generally cylindrical axle disposed within said body with an outward wall portion thereof positioned immediately adjacent to an inward wall portion of said body, said axle having first and second axle ends and extending therebetween at least in part longitudinally within said body in generally coaxial arrangement therewith, said first axle end being positioned outward of said body beyond said first body end and said axle extending from said first axle end into said first body end to said second axle end which is positioned toward a midportion of said body between said first and second body ends, said axle having a first end portion located toward said first axle end which is fixedly attached to said boom attachment head to prevent relative rotational movement therebetween, said body being selectively rotatable relative to said axle about said body longitudinal axis, but restrained against longitudinal movement relative to said axle, at least said outward wall portion of said axle toward said first body end being in engagement with said inward wall portion of said body and at least said outward wall portion of said axle toward said second axle end being in engagement with said inward wall portion of said body at said body midportion, said outward wall portions of said axle toward said first body end and said second axle end being spaced apart by a sufficient distance to provide increased stability against forces generated during use of the dipper stick assembly tending to move said body out of coaxial alignment with said axle; and linear-to-rotary transmission means disposed within said body and operable for producing rotational movement of said body relative to said axle, said transmission means including a piston for the selective application of fluid pressure to one or an other side thereof to produce linear movement of said piston within said body selectively toward said first and second body ends, and means for translating linear movement of said piston toward said first and second body ends into clockwise and counterclockwise relative rotational movement between said body and said axle to selectively rotate said work implement attachment head and hence the work implement about said body longitudinal axis independent of said boom attachment head and hence the boom arm.

2. The rotary dipper stick assembly of claim 1, further including a rotary thrust bearing positioned toward said first body end and transmitting thrust loads on said body in both directions along said body longitudinal axis to said boom attachment head while permitting rotation of said body relative to said axle and restraining relative longitudinal movement between said body and said axle.

3. The rotary dipper stick assembly of claim 2 wherein said rotary thrust bearing includes first and second bearing members rotatable relative to each other and transmitting thrust loads on said body in both longitudinal direction therebetween, said first bearing member being non-rotatable relative to said axle and rigidly connected to said boom attachment head, and said second bearing member being rotatable relative to said axle and rigidly connected to said body.

4. The rotary dipper stick assembly of claim 3 wherein said rotary thrust bearing is a turntable bearing.

5. The rotary dipper stick assembly of claim 1 usable with a vehicle providing fluid supply lines terminating at about said boom attachment heat, wherein said non-rotating axle has a plurality of longitudinally extending axle fluid passageways therein for the connection of the fluid supply lines thereto, and each of said axle fluid passageways is positioned for continuous fluid communication with a corresponding one of a plurality of ports in a sidewall of said body as said body rotates, and the assembly further includes fluid seals positioned between said axle and said body sidewall to prevent leakage of fluid as the fluid is communicated between corresponding ones of said axle fluid passageways and body sidewall ports.

6. The rotary dipper stick assembly of claim 5, further including an additional longitudinally extending fluid passageway in said axle positioned to communicate fluid directly from one of the fluid supply lines to within said body to a side of said piston toward said first body end for linear movement of said piston toward said second body end.

7. The rotary dipper stick assembly of claim 5 wherein said axle has formed in a surface portion thereof longitudinally inward of said first body end a plurality of radially outward opening channels, which extend circumferentially fully about said axle, each of said channels being in fluid communication with one of said axle fluid passageways and longitudinally positioned on said axle to be in continuous fluid communication with one of said body sidewall ports as said body rotates.

8. The rotary dipper stick assembly of claim 1 wherein said axle includes an interiorly splined axle recess toward said second axle end and said body includes an interiorly splined body member toward said second body end, and wherein said piston has an exteriorly splined first end portion disposed within said splined axle recess and an exteriorly splined second end portion disposed within said splined body member, with a piston head located between said first and second piston end portions and in sliding engagement with an interior surface of said body to define a fluid tight chamber to each side of said piston head.

9. The rotary dipper stick assembly of claim 8 wherein said body includes a cylindrical sleeve and an exterior member, said exterior member having a first end portion projecting into said sleeve member at a location toward said second body end and a second end portion to which said work implement attachment head is attached.

10. The rotary dipper stick assembly of claim 9 wherein said first end portion of said exterior member has an interiorly splined recess which forms said splined body member.

11. A vehicle comprising:

a vehicle frame;

a boom arm pivotally connected to said vehicle frame and movable through a plane containing said boom arm;

a dipper stick actuator associated with said boom arm and selectively operable to pivotally move said boom arm through said plane;

a work implement;

a work implement actuator associated with said work implement and selectively operable to operate said work implement;

a boom attachment head having a first attachment portion attachable to the vehicle boom arm, and a second attachment portion attachable to the dipper stick actuator to provide pivotal movement of said boom attachment head through the boom plane upon actuation of the dipper stick actuator, said first attachment portion and said second attachment portion being selectively detachable form the boom arm and the dipper stick actuator;

a work implement attachment head having a third attachment portion attachable to the work implement to operate the work implement upon actuation of the work implement actuator, said third attachment portion being selectively detachable from the work implement;

an elongated, generally cylindrical outer body having a longitudinal axis and extending at least partially between said boom attachment head and said work implement attachment head, with a first body end toward said boom attachment head and a second body end toward said work implement attachment head, said body being rigidly attached to said work implement attachment head and having a fourth attachment portion spaced away from said work implement attachment head and attachable to the work implement actuator to apply a counterforce upon actuation of the work implement actuator to operate the work implement;

an elongated, generally cylindrical axle disposed within said body with an outward wall portion thereof positioned immediately adjacent to an inward wall portion of said body, said axle having first and second axle ends and extending therebetween at least in part longitudinally within said body in generally coaxial arrangement therewith, said first axle end being positioned outward of said body beyond said first body end and said axle extending from said first axle end into said first body end to said second axle end which is positioned toward a midportion of said body between said first and second body ends, said axle having a first end portion located toward said first axle end which is fixedly attached to said boom attachment head to prevent relative rotational movement therebetween, said body being selectively rotatable relative to said axle about said body longitudinal axis, but restrained against longitudinal movement relative to said axle, at least said outward wall portion of said axle toward said first body end being in engagement with said inward wall portion of said body and at least said outward wall portion of said axle toward said second axle end being in engagement with said inward wall portion of said body at said body midportion, said outward wall portions of said axle toward said first body end and said second axle end being spaced apart by a sufficient distance to provide increased stability against forces generated during use of the dipper stick assembly tending to move said body out of coaxial alignment with said axle; and linear-to-rotary transmission means disposed within said body and operable for producing rotational movement of said body relative to said axle, said transmission means including a piston for the selective application of fluid pressure to one or an other side thereof to produce linear movement of said piston within said body selectively toward said first and second body ends, and means for translating linear movement of said piston toward said first and second body ends into clockwise and counterclockwise relative rotational movement between said body and said axle to selectively rotate said work implement attachment head and hence the work implement about said body longitudinal axis independent of said boom attachment head and hence the boom arm.

12. The vehicle of claim 11, further including a rotary thrust bearing positioned toward said first body end and transmitting thrust loads on said body in both directions along said body longitudinal axis to said boom attachment head while permitting rotation of said body relative to said axle and restraining relative longitudinal movement between said body and said axle.

13. The vehicle of claim 12 wherein said rotary thrust bearing includes first and second bearing members rotatable relative to each other and transmitting thrust loads on said body in both longitudinal directions therebetween, said first bearing member being non-rotatable relative to said axle and rigidly connected to said boom attachment head, and said second bearing member being rotatable relative to said axle and rigidly connected to said body.

14. The vehicle of claim 13 wherein said rotary thrust bearing is a turntable bearing.

15. The vehicle of claim 11, further including fluid supply lines terminating at about said boom attachment head, wherein said non-rotating axle has a plurality of longitudinally extending axle fluid passageways therein for the connection of said fluid supply lines thereto, and each of said axle fluid passageways is positioned for continuous fluid communication with a corresponding one of a plurality of ports in a sidewall of said body as said body rotates, and the assembly further includes fluid seals positioned between said axle and said body sidewall to prevent leakage of fluid as the fluid is communicated between corresponding ones of said axle fluid passageways and body sidewall ports.

16. The vehicle of claim 15, further including an additional longitudinally extending fluid passageway in said axle positioned to communicate fluid directly from one of said fluid supply lines to within said body to a side of said piston toward said first body end for linear movement of said piston toward said second body end.

17. The vehicle of claim 15 wherein said axle has formed in a surface portion thereof longitudinally inward of said first body end a plurality of radially outward opening channels, which extend circumferentially fully about said axle, each of said channels being in fluid communication with one of said axle fluid passageways and longitudinally positioned on said axle to be in continuous fluid communication with one of said body sidewall ports as said body rotates.

* * * * *

UNITED STATES PATENT AND TRADEMARK OFFICE

CERTIFICATE OF CORRECTION

PATENT NO. : 5,158,420

DATED : October 27, 1992

INVENTOR(S) : Paul P. Weyer

It is certified that error appears in the above-identified patent and that said Letters Patent is hereby corrected as shown below:

In column 15, claim 3, line 47, please delete "direction" and substitute therefor --directions--.

In column 15, claim 5, line 56, please delete "heat" and substitute therefor --head--.

In column 16, claim 11, line 61, please delete "form" and substitute therefor --from--.

Signed and Sealed this

Twelfth Day of October, 1993

*Attest:*

*Attesting Officer*

BRUCE LEHMAN

*Commissioner of Patents and Trademarks*